US009303874B2

(12) United States Patent
Johnson et al.

(10) Patent No.: US 9,303,874 B2
(45) Date of Patent: Apr. 5, 2016

(54) SYSTEMS AND METHODS FOR PREVENTING FLASHBACK IN A COMBUSTOR ASSEMBLY

(75) Inventors: Thomas Edward Johnson, Greenville, SC (US); Willy Steve Ziminsky, Greenville, SC (US); Christian Xavier Stevenson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 680 days.

(21) Appl. No.: 13/423,854

(22) Filed: Mar. 19, 2012

(65) Prior Publication Data

US 2013/0239581 A1 Sep. 19, 2013

(51) Int. Cl.
*F23R 3/28* (2006.01)

(52) U.S. Cl.
CPC ..... *F23R 3/286* (2013.01); *F23R 2900/00002* (2013.01)

(58) Field of Classification Search
CPC ..... F23R 3/28; F23R 3/283; F23R 3/286; F23R 3/30; F23R 3/32; F23R 3/34; F23R 3/36; F23R 3/40; F23R 3/42; F23R 3/46
USPC ..... 60/776, 737–748
See application file for complete search history.

(56) References Cited

U.S. PATENT DOCUMENTS

| | | | | |
|---|---|---|---|---|
| 7,624,578 | B2 | 12/2009 | Hadley | |
| 8,413,446 | B2 * | 4/2013 | Callas et al. | F02C 7/22 60/737 |
| 2010/0139281 | A1 * | 6/2010 | Callas et al. | 60/737 |
| 2011/0083439 | A1 * | 4/2011 | Zuo et al. | 60/737 |
| 2011/0099969 | A1 | 5/2011 | Ku | |

OTHER PUBLICATIONS

Chinese Patent Office Action for Application No. CN 201310020062.4 dated Nov. 30, 2015.

* cited by examiner

*Primary Examiner* — Craig Kim
(74) *Attorney, Agent, or Firm* — Sutherland Asbill & Brennan LLP

(57) ABSTRACT

Embodiments of the present application include a combustor assembly. The combustor assembly may include a combustion chamber, a first plenum, a second plenum, and one or more elongate air/fuel premixing injection tubes. Each of the elongate air/fuel premixing injection tubes may include a first length at least partially disposed within the first plenum and configured to receive a first fluid from the first plenum. Moreover, each of the elongate air/fuel premixing injection tubes may include a second length disposed downstream of the first length and at least partially disposed within the second plenum. The second length may be formed of a porous wall configured to allow a second fluid from the second plenum to enter the second length and create a boundary layer about the porous wall.

20 Claims, 2 Drawing Sheets

SYSTEMS AND METHODS FOR PREVENTING FLASHBACK IN A COMBUSTOR ASSEMBLY

STATEMENT REGARDING FEDERALLY SPONSORED RESEARCH OR DEVELOPMENT

This invention was made with Government support under contract number DE-FC26-05NT42643 awarded by the Department of Energy. The Government has certain rights in this invention.

FIELD OF THE DISCLOSURE

Embodiments of the present application relate generally to gas turbine engines and more particularly to combustor assemblies.

BACKGROUND OF THE DISCLOSURE

Gas turbine efficiency generally increases with the temperature of the combustion gas stream. Higher combustion gas stream temperatures, however, may produce higher levels of undesirable emissions such as nitrogen oxides (NOx) and the like. NOx emissions generally are subject to governmental regulations. Improved gas turbine efficiency therefore must be balanced with compliance with emissions regulations.

Lower NOx emission levels may be achieved by providing for good mixing of the fuel stream and the air stream. For example, the fuel stream and the air stream may be premixed in a Dry Low NOx (DLN) combustor before being admitted to a reaction or a combustion zone. Such premixing tends to reduce combustion temperatures and NOx emissions output.

The fuel stream and the air stream are generally premixed in tightly packed bundles of air/fuel premixing tubes to form axial jets in the combustion chamber. The tightly packed bundles of air/fuel premixing tubes may suffer from flash back. For example, hydrogen fuels or other highly reactive fuels may flash back within the slower moving boundary layers along the walls of the premixing tubes.

BRIEF DESCRIPTION OF THE DISCLOSURE

Some or all of the above needs and/or problems may be addressed by certain embodiments of the present application. According to one embodiment, there is disclosed a combustor assembly. The combustor assembly may include a combustion chamber, a first plenum, a second plenum, and one or more elongate air/fuel premixing injection tubes. Each of the elongate air/fuel premixing injection tubes may include a first length at least partially disposed within the first plenum and configured to receive a first fluid from the first plenum. Moreover, each of the elongate air/fuel premixing injection tubes may include a second length disposed downstream of the first length and at least partially disposed within the second plenum. The second length may be formed of a porous wall configured to allow a second fluid from the second plenum to enter the second length and create a boundary layer about the porous wall. In this manner, in certain embodiments, the second plenum may carry a gaseous fluid that may be an inert gas or a fuel with a low reactivity, which will be referred to hereafter as a fuel.

According to another embodiment, there is disclosed a combustor assembly. The combustor assembly may include a combustion chamber, a first fuel plenum, a second fuel plenum, and one or more elongate air/fuel premixing injection tubes. Each of the elongate air/fuel premixing injection tubes may include a first length at least partially disposed within the first fuel plenum and configured to receive a first fuel from the first fuel plenum to create a first air/fuel mixture. Moreover, each of the elongate air/fuel premixing injection tubes may include a second length disposed downstream of the first length and at least partially disposed within the second fuel plenum. The second length may be formed of a porous wall configured to allow a second fuel from the second fuel plenum to enter the second length and create a boundary layer of a second air/fuel mixture about the porous wall.

Further, according to another embodiment, there is disclosed a method for air/fuel premixing in a combustor. The method may include directing a flow of air into one or more elongate air/fuel premixing injection tubes. The method may also include directing a first fuel from a first fuel plenum into the elongate air/fuel premixing injection tubes along a first length. Moreover, the method may include diffusing a second fuel from a second fuel plenum along a second length into the elongate air/fuel premixing injection tubes through a porous wall to create a boundary layer about the porous wall downstream of the first length.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments will now be described more fully hereinafter with reference to the accompanying drawings, in which some, but not all embodiments are shown. The present application may be embodied in many different forms and should not be construed as limited to the embodiments set forth herein. Like numbers refer to like elements throughout.

Figure 1:
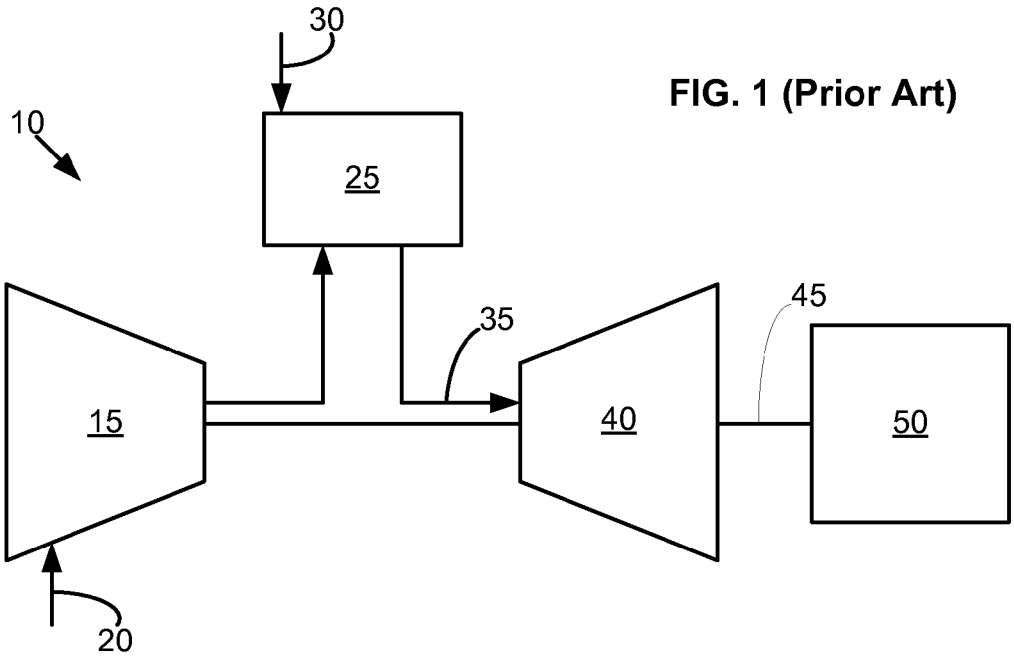
FIG. 1 (Prior Art)
FIG. 1 is a schematic of an example diagram of a gas turbine engine with a compressor, a combustor, and a turbine.

Illustrative embodiments are directed to, among other things, a combustor assembly including a trapped vortex cavity. FIG. 1 shows a schematic view of a gas turbine engine 10 as may be used herein. As is known, the gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, New York, including, but not limited to, those such as a 7 or a 9 series heavy duty gas turbine engine and the like. The gas turbine engine 10 may have different configurations and may use other types of components.

Other types of gas turbine engines also may be used herein. Multiple gas turbine engines, other types of turbines, and other types of power generation equipment also may be used herein together.

Figure 2:
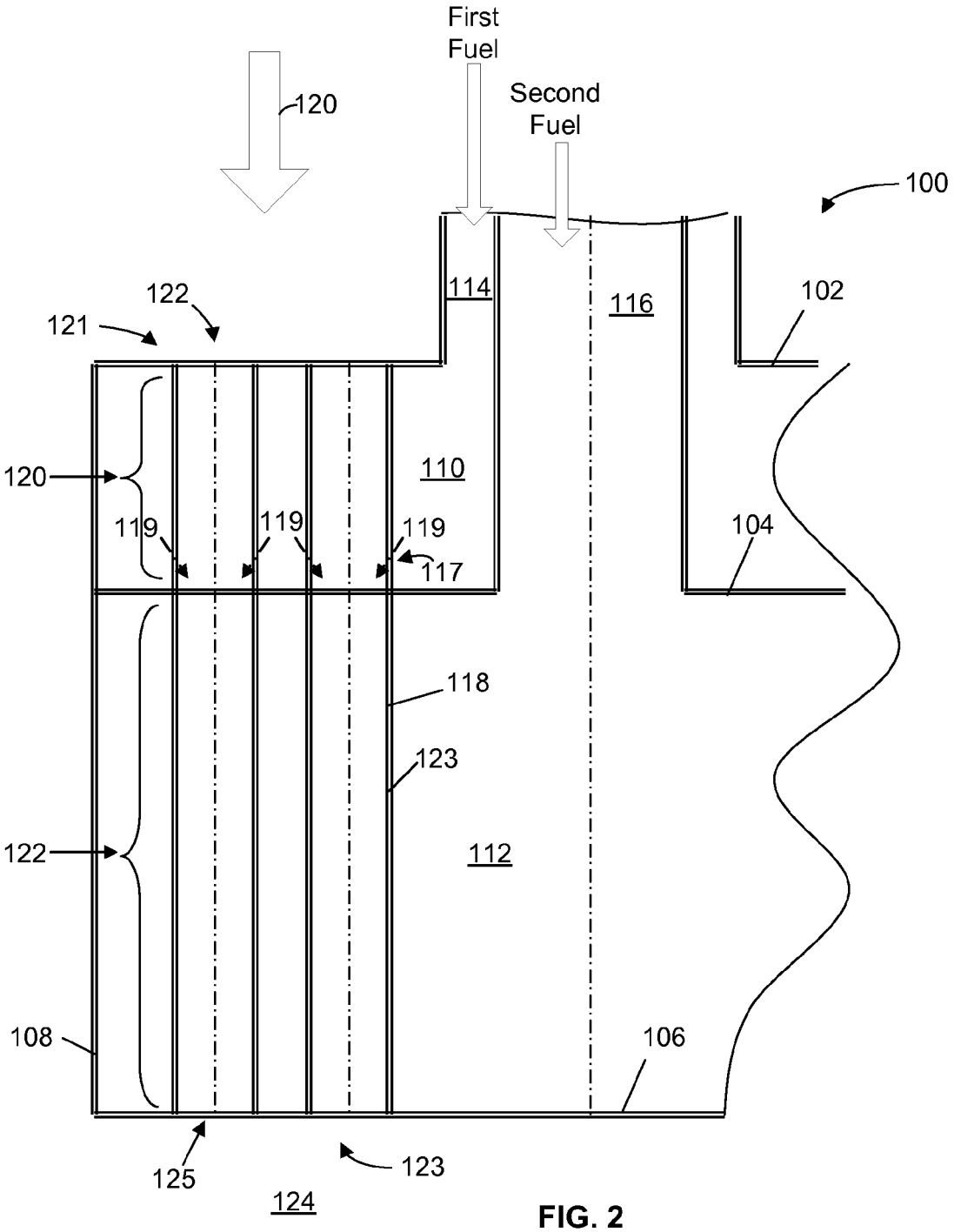
FIG. 2 is a cross-sectional view of a portion of a combustor assembly, according to an embodiment.

FIG. 2 depicts a component of the combustor 25 in FIG. 1; specifically, a sectional view of an annular micro-mixer fuel injector 100 or a portion thereof. In certain embodiments, the fuel injector 100 may include a forward plate 102, a mid-plate 104, and an aft plate 106. The forward plate 102, the mid-plate 104, and the aft plate 106 may be surrounded by an outer sleeve 108. In certain aspects, the forward plate 102, the mid-plate 104, and the outer sleeve 108 may collectively form a first fuel plenum 110. In other aspects, the mid-plate 104, the aft plate 106, and the outer sleeve 108 may collectively form a second fuel plenum 112. A first conduit 114 may supply a first fuel to the first fuel plenum 110, and a second conduit 116 may supply a second fuel to the second fuel plenum 112.

A number of elongate air/fuel premixing injection tubes 118 may be at least partially disposed within the first fuel plenum 110 and the second fuel plenum 112. For example, the elongate air/fuel premixing injection tubes 118 may include a first end 121 that extends from the forward plate 102, through the mid plate 104, and terminate at a second end 123 about the aft plate 106. A flow of high pressure compressor discharge air 120 may enter the elongate air/fuel premixing injection tubes 118 at an upstream inlet 122, where the air mixes with the first and second fuel discussed below, and discharges into a combustor 124 at a downstream exit 125.

The elongate air/fuel premixing injection tubes 118 may include a first length 120 at least partially disposed within the first fuel plenum 110. The first length 120 may be configured to receive the first fuel from the first fuel plenum 110 to create a first air/fuel mixture within the elongate air/fuel premixing injection tubes 118. For example, the first fuel may enter the elongate air/fuel premixing injection tubes 118 through one or more apertures 117 (as indicated by flow path arrows 119) along the first length 120 to create a first air/fuel mixture within the elongate air/fuel premixing injection tubes 118.

The elongate air/fuel premixing injection tubes 118 may also include a second length 122 disposed downstream of the first length 120 and at least partially disposed within the second fuel plenum 112. The second length 122 may be formed of a porous wall 123 configured to allow the second fuel from the second fuel plenum 112 to uniformly effuse along the second length 122 and create a boundary layer of a second air/fuel mixture along an inner portion of the porous wall 123. For example, the second length 122 may be formed of a heat resistant, porous material, such as, for example, a dense open cell metal. Moreover, the second length 122 may include, for example, a tube with lots of very small holes (produced, for example, with an electron beam or laser), or compacted wire mesh. The second length 122 may also be formed of a ceramic, metallic, or cera-metallic material.

In operation, the first fuel enters the first fuel plenum 110 through the first fuel conduit 114. The first fuel then enters the elongate air/fuel premixing injection tubes 118 via one or more apertures 117 along the first length 120 where it mixes with the air as it travels down the first and second length 120 and 122 to the combustor 124. As stated above, a boundary layer of slower moving premixed air/fuel mixture may form adjacent to the porous wall 123 of the elongate air/fuel premixing injection tubes 118. If the air/fuel mixture within the boundary layer is reactive enough and slow enough a flame can propagate upstream from the combustor 124 into the elongate air/fuel premixing injection tubes 118. This will typically destroy the fuel injector, as the flame temperatures may be substantially higher than the melting temperature of tube material. To solve this problem, a second fuel or fluid may be allowed to effuse through the porous wall 123 of the elongate air/fuel premixing injection tubes 118 along the second length 122 into the slower moving boundary layer without causing any recirculation zones. The second fuel that effuses into the boundary layer may be of a lower reactivity or no reactivity, such as, for example, nitrogen. In certain aspects, the second fuel entering the elongate air/fuel premixing injection tubes 18 via the porous wall 123 may force the first air/fuel mixture, which is more reactive, away from the porous wall 123. Accordingly, the second air/fuel mixture, which is less reactive, may be disposed about the porous wall 123, forming the boundary layer.

Although the disclosure has been illustrated and described in typical embodiments, it is not intended to be limited to the details shown, because various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the scope of the disclosure as defined by the following claims.

That which is claimed:

1. A combustor assembly, comprising:
a combustion chamber;
a first plenum;
a second plenum; and
one or more elongate air/fuel premixing injection tubes, each of the one or more elongate air/fuel premixing injection tubes comprising:
a first length at least partially disposed within the first plenum and configured to receive a first fluid from the first plenum, wherein the first length is defined between a forward plate and a mid-plate; and
a second length disposed downstream of the first length and at least partially disposed within the second plenum, wherein the second length is defined between the mid-plate and an aft plate, wherein the second length is formed of a porous wall comprising a dense open cell material configured to allow a second fluid from the second plenum to uniformly effuse along the second length and create a boundary layer about the porous wall.

2. The combustor assembly of claim 1, wherein the one or more elongate air/fuel premixing injection tubes each comprise:
a first end open to a flow of compressed air; and
a second end open to the combustion chamber.

3. The combustor assembly of claim 1, wherein the first length comprises one or more apertures configured to receive the first fluid from the first plenum.

4. The combustor assembly of claim 1, wherein the first plenum and the second plenum are disposed adjacent to each other.

5. The combustor assembly of claim 1, wherein the porous wall is formed of one of a ceramic, metallic, or cera-metallic material.

6. The combustor assembly of claim 1, wherein the first fluid is a high reactivity fuel.

7. The combustor assembly of claim 1, wherein the second fluid is a low reactivity fuel.

8. The combustor assembly of claim 1, wherein the second fluid is a no reactivity fluid.

9. The combustor assembly of claim 1, wherein the second fluid is nitrogen.

10. The combustor assembly of claim 1, wherein the lean boundary layer is incombustible due to the second fluid having no reactivity.

11. The combustor assembly of claim 1, wherein a velocity of the air/fuel mixture at a center of the one or more elongate air/fuel premixing injection tubes is greater than a velocity of the boundary layer.

12. The combustor assembly of claim 1, wherein the second fluid entering the one or more elongate air/fuel premixing injection tubes via the porous wall forces the air/fuel mixture away from the porous wall.

13. The combustor assembly of claim 1, wherein the dense open cell material comprises a dense open cell metal.

14. A combustor assembly, comprising:

a combustion chamber;

a first fuel plenum defined by a forward plate, a mid-plate, and an outer sleeve;

a second fuel plenum defined by an aft plate, the mid-plate, and the outer sleeve; and one or more elongate air/fuel premixing injection tubes, each of the one or more elongate air/fuel premixing injection tubes comprising:

a first length at least partially disposed within the first fuel plenum and configured to receive a first fuel from the first fuel plenum to create a first air/fuel mixture, wherein the first length is defined between the forward plate and the mid-plate; and a second length disposed downstream of the first length and at least partially disposed within the second fuel plenum, wherein the second length is defined between the mid-plate and the aft plate, wherein the second length is formed of a porous wall comprising a dense open cell material configured to allow a second fuel from the second fuel plenum to uniformly effuse along the second length and create a boundary layer of a second air/fuel mixture about the porous wall.

15. The combustor assembly of claim 14, wherein the one or more elongate air/fuel premixing injection tubes each comprise:

a first end open to a flow of compressed air; and a second end open to the combustion chamber.

16. The combustor assembly of claim 14, wherein the first fuel is a high reactivity fuel and the second fuel is a low reactivity fuel.

17. The combustor assembly of claim 14, wherein the second fuel is nitrogen.

18. The combustor assembly of claim 14, wherein a velocity of the first air/fuel mixture at a center of the one or more elongate air/fuel premixing injection tubes is greater than a velocity of the second air/fuel mixture at the boundary layer.

19. The combustor assembly of claim 14, wherein the second fluid entering the one or more elongate air/fuel premixing injection tubes via the porous wall forces the first air/fuel mixture away from the porous wall.

20. A method for air/fuel premixing in a combustor, comprising:

directing a flow of air into one or more elongate air/fuel premixing injection tubes;

directing a first fuel from a first fuel plenum into the one or more elongate air/fuel premixing injection tubes along a first length defined between a forward plate and a mid-plate; and uniformly effusing a second fuel from a second fuel plenum along a second length defined between the mid-plate and an aft plate into the one or more elongate air/fuel premixing injection tubes through a porous wall comprising a dense open cell material to create a boundary layer about the porous wall downstream of the first length.

* * * * *